US007435136B2

(12) United States Patent
Lutsch et al.

(10) Patent No.: US 7,435,136 B2
(45) Date of Patent: Oct. 14, 2008

(54) CONNECTOR

(75) Inventors: Harald Michael Lutsch, Ottrau (DE); Vladimir Buden, Zagreb (HR); Minja Adzic, Zagreb (HR)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 11/775,528

(22) Filed: Jul. 10, 2007

(65) Prior Publication Data

US 2008/0014794 A1 Jan. 17, 2008

(30) Foreign Application Priority Data

Jul. 12, 2006 (DE) ..... 10 2006 032 575

(51) Int. Cl.
*H01R 13/40* (2006.01)

(52) U.S. Cl. ..... 439/587

(58) Field of Classification Search ..... 439/587, 439/589, 281, 271–272, 278
See application file for complete search history.

(56) References Cited

U.S. PATENT DOCUMENTS 4,944,688 A 7/1990 Lundergan
5,707,251 A 1/1998 Sakai et al.
6,053,754 A * 4/2000 Kano et al. ..... 439/281
6,203,348 B1 * 3/2001 Fukuda ..... 439/275
6,521,160 B2 * 2/2003 Suzuki ..... 264/267
6,913,494 B2 * 7/2005 Ward et al. ..... 439/752

FOREIGN PATENT DOCUMENTS

DE 80 05 677 U1 8/1980

* cited by examiner

*Primary Examiner*—Jean F Duverne
(74) *Attorney, Agent, or Firm*—Sughrue Mion, PLLC

(57) ABSTRACT

A connector (1) which serves to be connected to a counter connector, comprising a housing (2) which is provided with a plurality of first and second receiving chambers (3, 4) extending parallel to a longitudinal axis (5), wherein the first receiving chambers (3) serve to receive a contact element (14) connected to a cable (15) and which housing (2), on its rear side (6), comprises openings (8, 9) of the receiving chambers (3, 4), as well as at least one mat seal (18, 19) which rests against the rear side (6) of the housing (2) and comprises apertures (20, 21) which are aligned with the openings (8, 9), wherein there are provided sealing elements (16) which are received in the second receiving chambers (4), wherein the sealing elements (16) each comprise a sealing portion (17) which projects beyond the rear side (6) of the housing (2) from the opening (9) of the respective second receiving chamber (4) and is sealingly positioned in one of the apertures (21) of the at least one mat seal (18, 19).

2 Claims, 3 Drawing Sheets

CONNECTOR

BACKGROUND OF THE INVENTION

The invention relates to a connector which serves to be connected to a counter connector, comprising a housing which is provided with a plurality of first and second receiving chambers extending parallel to a longitudinal axis, wherein the first receiving chambers serve to receive a contact element connected to a cable and which housing, on its rear side, comprises openings of the receiving chambers, as well as at least one mat seal which rests against the rear side of the housing and comprises apertures which are aligned with the openings.

Such a connector is shown in U.S. Pat. No. 4,944,688. The mat seal is held by a mat seal holder so as to rest against the rear side of the housing. The mat seal holder rests against the mat seal side facing away from the rear side and comprises fixing arms which embrace the mat seal, wherein the fixing arms extend behind locking projections of the housing. The mat seal holder is thus fixed to the housing. The mat seal is arranged and held between the housing and the mat seal holder. The mat seal holder comprises apertures which are aligned with the apertures of the mat seal, so that the cables of the contact elements can be guided out of the receiving chamber through the apertures of the mat seal and of the mat seal holder.

As connectors frequently comprise different configurations, i.e. depending on the configuration, they comprise a different number of contact elements in different receiving chambers, not all the receiving chambers of every configuration are provided with contact elements. In such cases it is necessary for those receiving chambers not provided with contact elements to be sealed. To avoid having to provide for every configuration a different mat seal which, in the region of the receiving chambers not provided with contact elements, does not comprise any apertures, it is proposed by U.S. Pat. No. 4,944,688 to provide the mat seal holder with sealing projections which close the apertures of the mat seal holder and which project into the apertures of the mat seal. The sealing projections are formed on to the mat seal holder and can be removed by a tool. The sealing projections are removed from those apertures which are aligned with those receiving chambers which are provided with contact elements. For this purpose, the sealing projections are broken off by the tool so that a cable of a contact element can be guided through the aperture of the mat seal holder.

The disadvantage of this solution is that, during assembly, initially all not required sealing projections have to be broken off and removed.

SUMMARY OF THE INVENTION

It is the object of the present invention to provide an initially mentioned connector which permits an easy assembly procedure.

The objective is achieved by providing sealing elements which are received in the second receiving chambers, wherein the sealing elements each comprise a sealing portion which projects beyond the rear side of the housing from the opening of the respective second receiving chamber and is sealingly positioned in one of the apertures of the at least one mat seal.

In this way, the first receiving chambers, i.e. the first partial number of all receiving chambers, are provided with contact elements and the second receiving chambers, i.e. a second partial number of all receiving chambers, are provided with sealing elements. As the sealing elements project beyond the rear side of the housing and are positioned in the apertures of the mat seal, it is possible to use the same mat seal for each configuration.

There is no need for any tools to allow adaptation of the different configurations. On the contrary, providing the receiving chambers with sealing elements requires the same process stages required for providing the contact elements. There is thus no need for changing the assembly procedure.

To be able to hold the at least one mat seal at the housing, at least one mat seal holder can be removably fixed to the rear side of the housing, wherein the at least one mat seal is held between the housing and the at least one mat seal holder. The mat seal holder comprises apertures which are aligned with the apertures of the at least one mat seal. The same mat seal holder can be used for each configuration.

According to a preferred embodiment, it is proposed that there is provided at least one secondary locking element which is movable at the housing between a locking position and a releasing position and which, in the locking position, projects by means of one locking projection into at least one receiving chamber.

The contact elements are prevented by the secondary locking element from being pulled out of the receiving chambers. The secondary locking element is movably attached at the housing between a locking position and a releasing position. There can be provided one or more secondary locking elements. For example, the secondary locking element can be slidably guided at the housing or pivotably attached thereto. The secondary locking element can comprise a locking projection which, in the locking position, projects simultaneously into several receiving chambers. With reference to the longitudinal extension of the receiving chamber, the locking projection engages the receiving chamber between the two ends of same transversely to the longitudinal extension. As usual, the contact elements comprise a locking face which supports the contact elements against one of the locking projections of the secondary locking element, when attempts are made to pull the contact element out of the receiving chamber.

In a preferred embodiment, the sealing element is secured by the same secondary locking element which is used for securing the contact elements. For this purpose, it is proposed that the sealing elements each comprise a locking face by means of which the sealing elements are supported against the locking projection of the at least one secondary locking element in order to secure the sealing element against being pulled out of the respective receiving chamber.

BRIEF DESCRIPTION OF THE DRAWINGS

A preferred embodiment will be described below in greater detail with reference to the following drawings wherein

FIG. 1 is a perspective illustration of an inventive connector. FIG. 2 is a longitudinal section through the connector according to FIG. 1, with FIGS. 1 and 2 being described jointly below.

DETAILED DESCRIPTION OF THE INVENTION

Figure 1:
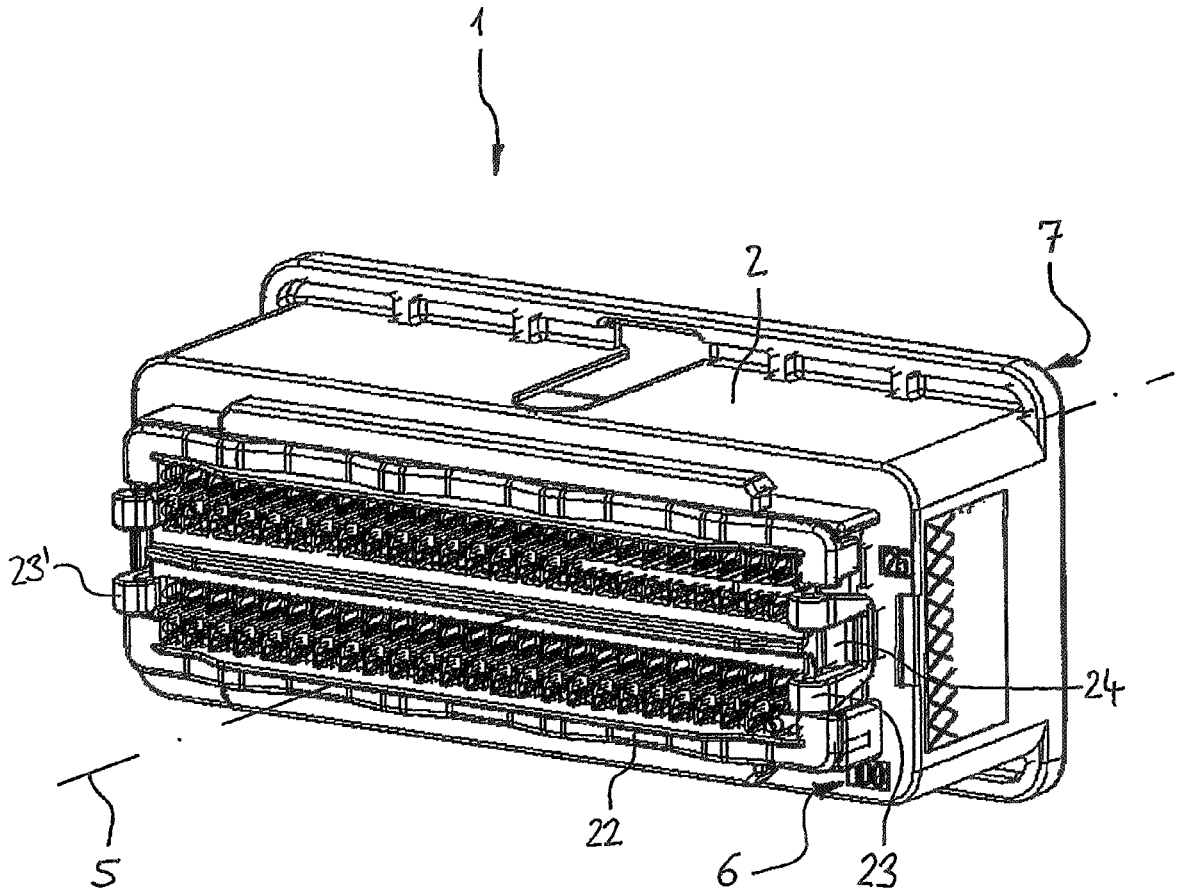
FIG. 1 is a perspective view of an inventive connector.

The connector 1 comprises a housing 2 in which there are provided first receiving chambers 3 and second receiving chambers 4 which are identical relative to one annother. The receiving chambers 3, 4 are arranged so as to extend parallel to the longitudinal axis 5, with the connector 1, in the direction of the longitudinal axis 5, being connected to a counter connector.

The housing 2 comprises a rear side 6 and a front side 7 facing away therefrom. In the rear side 6, there are provided first rear side openings 8 which lead to the first receiving chambers 3, as well as second rear side openings 9 which lead to the second receiving chambers 4. In a cross-section viewed at a right angle relative to the longitudinal axis 5, the rear side openings 8, 9 have the same shape and size as the receiving chambers 3, 4.

The front side 7 comprises a first front side opening 9 which lead to the first receiving chambers 3 as well as second front side openings 10 which lead to the second receiving chambers 4. In a cross-sectional view, the front side openings 10, 11 are smaller than the receiving chambers 3, 4, so that the first front side opening 10 forms an inwardly pointing continuous first supporting face 12 and the second front side opening 11 forms a second continuous inwardly pointing supporting face 13.

In the first receiving chambers 3 there are arranged contact elements 14 which are inserted from the rear side 6 through the first rear side openings 8 into the first receiving chambers 3. At their ends facing the rear side 6 of the housing 2, the contact elements 14 are each connected to a cable 15 which is guided out of the respective first rear side opening 8 out of the first receiving chamber 3. Towards the front side 7 of the housing 2, the contact elements 14 are supported against the first supporting faces 12 because, at an end directed towards the front side 7, the contact elements 14 comprise a larger cross-section than the first front-side openings 10.

In the second receiving chambers 4 there are positioned sealing elements 16 which, by means of a sealing portion 17, project through the second rear side openings 9 from the second receiving chambers 4. Towards the front side 7, the sealing elements 16 are supported against the second supporting faces 13 because, at an end directed towards the front side 7, they comprise a greater cross-section than the second front side openings 11.

At the rear side 6, two mat seals 18, 19 rest against the housing. Per receiving chamber 3, 4, the mat seals 18, 19 comprise apertures 20, 21 which are each aligned with one of the rear side openings 8, 9. For the purpose of sealing the receiving chambers 3, 4, the mat seals 18, 19 rest sealingly against the rear side 6 of the housing 2. Furthermore, the cables 15 are sealingly guided through a first number of apertures 20, 21. In addition, the sealing portions 17 of the sealing elements 16 project into a second partial number of apertures 20, 21 and are positioned sealingly therein. For this purpose, the cross-sections of the sealing portions comprise approximately the same shape and size as the cables.

On the rear side 6 of the housing 2, a mat seal holder 22 is connected to the housing 2, which mat seal holder 22, by means of fixing arms 23, engages behind fixing projections 24 of the housing 2 and is removably connected to the housing 2. The mat seals 18, 19 are arranged between the mat seal holder 22 and the rear side 6 of the housing and held therebetween. The mat seal holder 22, per aperture 20, 21 of the mat seals 18, 19, is provided with apertures 25 which are aligned with the apertures 20, 21 of the mat seals 18, 19, so that cables 10 can be guided through the apertures 25 of the mat seal holder 22.

Figure 3:
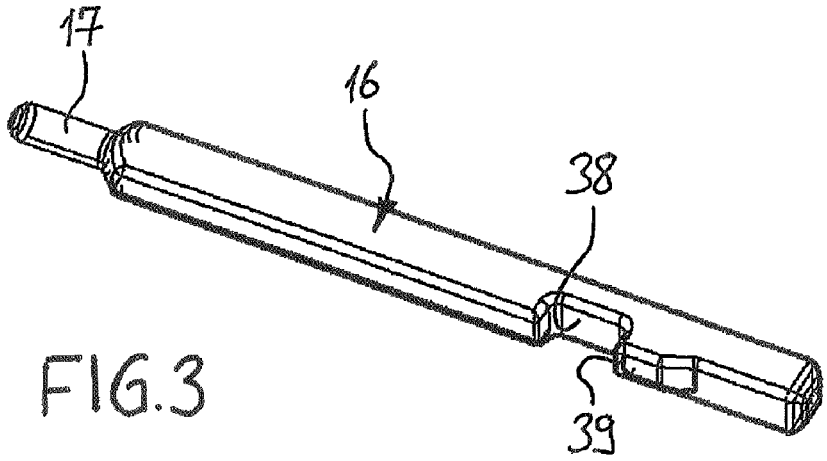
FIG. 3 is a perspective view of an inventive sealing element.
Figure 4:
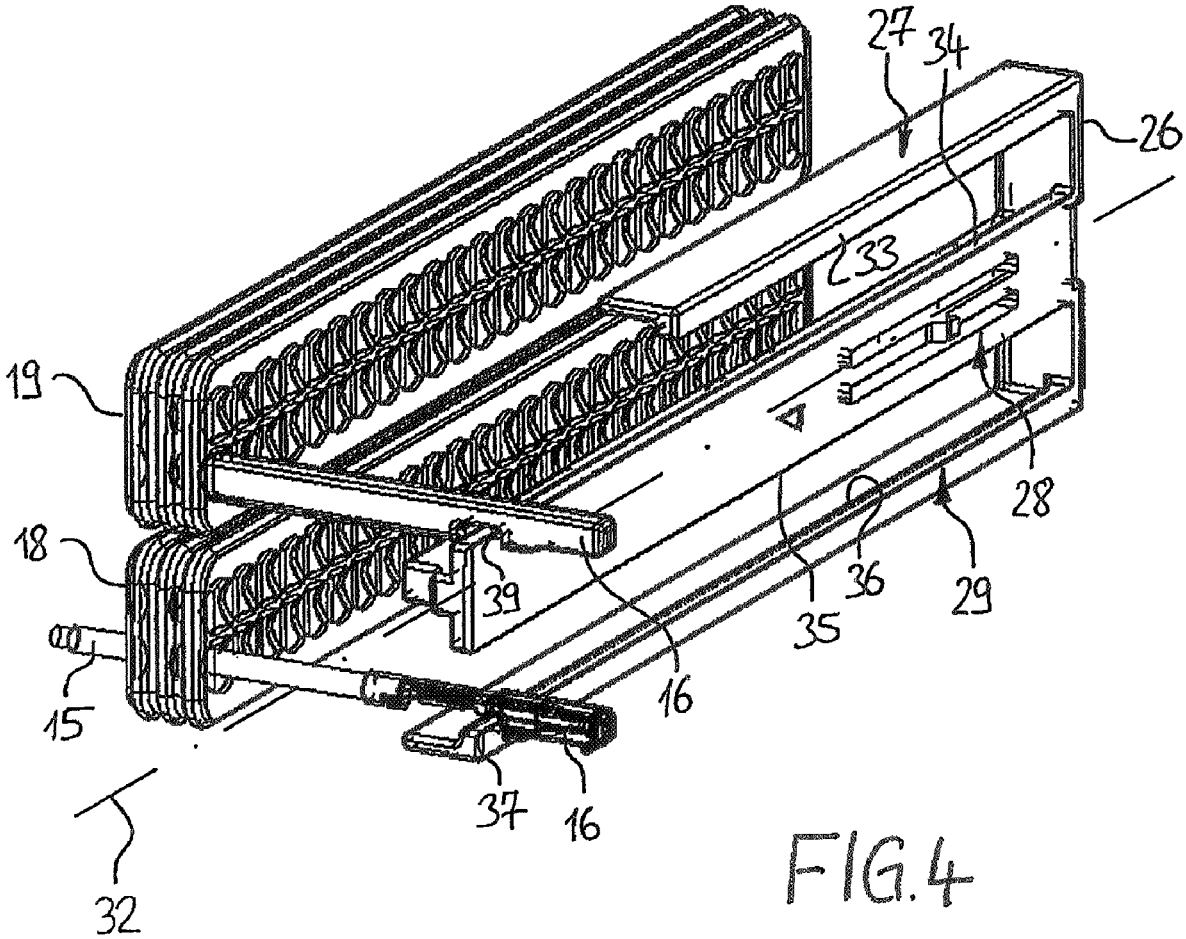
FIG. 4 is a perspective view of two mat seals, of a sealing element, of a contact element and of a secondary locking element.

The contact elements 14 and the sealing elements 16 are secured by a secondary locking element 26 against being pulled out of the receiving chambers 3, 4. The locking of the contact elements 14 and of the sealing elements 16 is particularly clearly illustrated in FIG. 4, with the detailed shape of the sealing elements being shown in FIG. 3.

Figure 2:
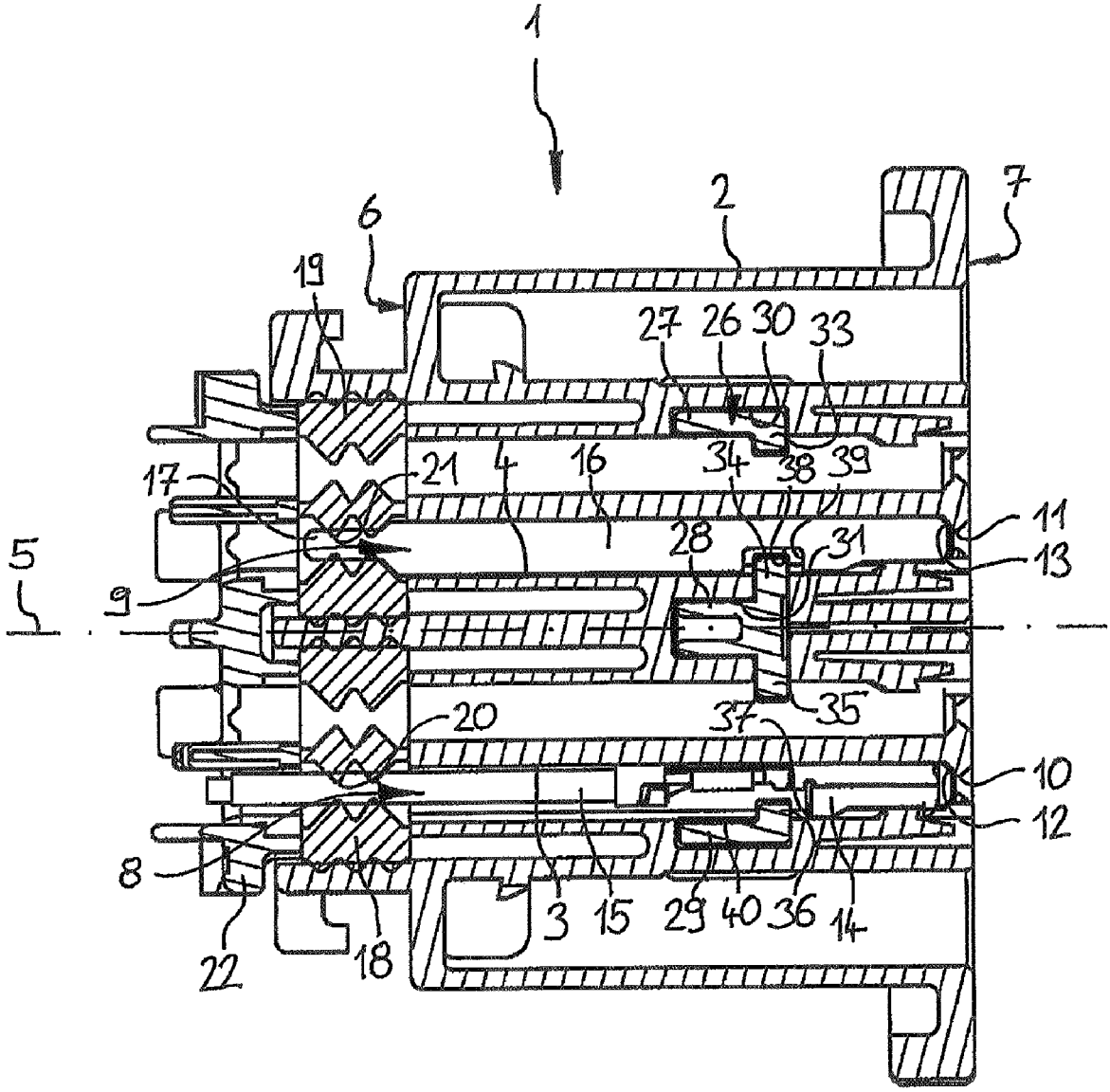
FIG. 2 is a longitudinal section through the connector according to FIG. 1 with first receiving chambers provided with contact elements and second receiving chambers provided with sealing elements.

The secondary locking element 26 is comb-shaped, having a first arm 27, a second arm 28 and a third arm 29. By means of the arms 27, 28, 29, the secondary locking element 26 is guided in correspondingly designed guiding recesses 30, 31, 40 in the housing 2 so as to be displaceable transversely to the longitudinal axis 5 at the housing 2. The secondary locking element 26 is displaceable between a releasing position extracted out of the guiding recesses 30, 31, 40 and a locking position in which it is pushed into the guiding recess 30, 31, 40. The first arm 27 comprises a first locking projection which extends along a displacement axis 32 of the secondary locking element 26 and which extends partially transversely into a first partial number of receiving chambers, if the secondary locking element 26 is in its locking position. The second arm 28 comprises a second locking projection 34 which projects into a second partial number of receiving chambers 4. Furthermore, the second arm 28 comprises a third locking projection 35 which, in the locking position of the secondary locking element 26, projects into a third partial number of receiving chambers. A fourth locking projection 36 provided at the third arm 29 projects into a fourth partial number of the receiving chambers 3. FIG. 2, in a longitudinal section, shows how the fourth locking projection 36 projects into a first receiving chamber 3 and narrows the first receiving chamber 3 in a cross-sectional view. In the region of the fourth locking projection 36, the contact element 14 is narrower and comprises a locking face 37 which points towards the fourth locking projection 26 and which, in the case of an attempt to pull the contact element 14 out of the first receiving chamber 3, comes to rest against the fourth locking projection 36, so that the contact element 14 is supported and prevented from being pulled out.

It can also be seen how the second locking projection 34 projects into the second receiving chamber 4, with the sealing element 16 comprising a locking recess 38 in the region of the second locking projection 34, wherein the locking recess 38 forming a locking face 39 which points towards the second locking projection 34 and which, if an attempt is made to pull the sealing element 16 out of the second receiving chamber 4, is supported against the second locking projection 34, so that the sealing element 14 is prevented from being pulled out.

What is claimed is:

1. A connector which serves to be connected to a counter connector, comprising:

a housing which is provided with a plurality of first and second receiving chambers extending parallel to a longitudinal axis, wherein the first receiving chambers serve to receive a contact element connected to a cable, and which housing, on its rear side, comprises openings of the receiving chambers, as well as at least one mat seal which rests against the rear side of the housing and comprises apertures which are aligned with the openings;

wherein there are provided sealing elements which are received in the second receiving chambers, wherein the sealing elements each comprise a sealing portion which projects beyond the rear side of the housing from the opening of the respective second receiving chamber and is sealingly positioned in one of the apertures of the at least one mat seal;

wherein at least one secondary locking element which is movable at the housing between a locking position and a releasing position and which in the locking position, projects by means of one locking projection into at least one receiving chamber; and wherein the sealing elements each comprise a locking face which supports the sealing elements against the at least one locking projection of the at least one secondary locking element in order to prevent the sealing element from being pulled out of the respective receiving chamber.

2. A connector according to claim 1, at least one mat seal holder is removably fixed to the rear side of the housing, wherein the at least one mat seal is held between the housing and the at least one mat seal holder, and that the mat seal holder comprises apertures which are aligned with the apertures of the at least one mat seal.

* * * * *